US012104871B2

(12) United States Patent
Christiansen

(10) Patent No.: US 12,104,871 B2
(45) Date of Patent: Oct. 1, 2024

(54) SELF-ADJUSTING SHOOTING REST

(71) Applicant: Branden Cook Christiansen, Cody, WY (US)

(72) Inventor: Branden Cook Christiansen, Cody, WY (US)

( * ) Notice: Subject to any disclaimer, the term of this patent is extended or adjusted under 35 U.S.C. 154(b) by 0 days.

(21) Appl. No.: 17/960,393

(22) Filed: Oct. 5, 2022

(65) Prior Publication Data

US 2023/0107403 A1 Apr. 6, 2023

Related U.S. Application Data

(60) Provisional application No. 63/252,782, filed on Oct. 6, 2021.

(51) Int. Cl.

| | |
|---|---|
| ***F41A 23/10*** | (2006.01) |
| ***F41A 23/14*** | (2006.01) |
| ***F41A 23/16*** | (2006.01) |

(52) U.S. Cl.

CPC ..... *F41A 23/16* (2013.01); *F41A 23/14* (2013.01)

(58) Field of Classification Search

CPC ..... F41A 23/10; F41A 23/16; F41A 23/14; F41G 5/06

See application file for complete search history.

(56) References Cited

U.S. PATENT DOCUMENTS

| | | | |
|---|---|---|---|
| 7,571,563 | B2 | 8/2009 | Peterson |
| 8,757,637 | B2 | 6/2014 | Tiedge |
| 9,591,902 | B1 | 3/2017 | Hyde et al. |
| 2016/0097238 | A1 | 4/2016 | Marek |
| 2019/0108770 | A1 | 4/2019 | Fischer et al. |
| 2022/0205762 | A1* | 6/2022 | Ehrlich ..... F41G 3/02 |

OTHER PUBLICATIONS

"Atlas Bipods," accu-shot.com. https://www.accu-shot.com/Atlas_Bipods.php [Date accessed: Jul. 12, 2021].

"Bipods", caldwellshooting.com. https://www.caldwellshooting.com/rests/bipods/ [Date accessed: Jul. 12, 2021].

"Swagger, The Bipod with Moves!", swaggerbipods.com. https://swaggerbipods.com/ [Date accessed: Jul. 12, 2021].

* cited by examiner

*Primary Examiner* — J. Woodrow Eldred

(74) *Attorney, Agent, or Firm* — Bold IP PLLC; Christopher Mayle

(57) ABSTRACT

The present invention is a shooting rest, which provides a solution to the problem of adjusting laterally, vertically, and rotationally while shooting without moving a bipod or tripod rest of a gun. The core components of the invention are a gun including a gun stock and rest with legs that include motors that are controlled by a controller to move the gun while aiming.

6 Claims, 3 Drawing Sheets

SELF-ADJUSTING SHOOTING REST

CROSS REFERENCE TO RELATED APPLICATIONS

This application claims priority to U.S. Provisional Patent No. 63/252,782 filed on Oct. 6, 2021, which is incorporated in its entirety.

BACKGROUND

Many types of rests for guns exist including bipods, tripods, and bench rests. Bench rests are not easily portable as well as some of the larger tripods. Some bipods and tripods are attached to the stock of the gun and are small enough to be easily carried attached to the gun. These rests are often adjusted manually, which can lead to a few main problems. First, users may need to adjust the height of the shooting rest and may need several adjustments to achieve the correct elevation. Second, uneven terrain will often cause the gun to not be level requiring "cant" or tilting adjustments to be made. Third, making these and other adjustments usually requires the shooter to leave the shooting position, reaching forward, and taking the marksman's eye off the target. If the target is not stationary or a new target is needed it may take too long to readjust for the target.

SUMMARY

The disclosed device is unique when compared with other known devices and solutions because it is a system provides remote sensory inputs from the marksman and other sensory inputs from the environment to allow the shooting rest to automatically adjust itself for uneven terrain, elevation corrections, lateral movement, or new target acquisition without needing to take the shooter's eyes off the target through an optic mounted above the stock.

The disclosed device is unique in that adjustments are manipulated different from other known devices or solutions. More specifically, the device is unique due to the presence of: (1) a controller configured to control the adjustments of the shooting rest to position the fire arm swiftly and accurately in any terrain. Common adjustments are, but not limited to, "cant" a pivot type adjustment that allows the gun to level by tilting left and right as well as vertical and lateral movements controlled by adjusting the length of the legs; and (2) a control interface located on the gun that can be used without looking at the controller so that the controller can receive commands from the shooter without the shooter having to take his or her eyes off the target. For example, during use, the legs may be manipulated with a joystick and the "cant" may be automatically adjusted by a leveling sensor. Using this combination allows for any motion of the gun while always staying level.

DETAILED DESCRIPTION

In the Summary above, in this Detailed Description, the claims below, and in the accompanying drawings, reference is made to particular features of the invention. It is to be understood that the disclosure of the invention in this specification does not include all possible combinations of such particular features. For example, where a particular feature is disclosed in the context of a particular aspect or embodiment of the invention, or a particular claim, that feature can also be used—to the extent possible—in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range including that number (which may be a range having an upper limit or no upper limit, depending on the variable being defined). For example, "at least 1" means 1 or more than 1. The term "at most" followed by a number is used herein to denote the end of a range, including that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)—(a second number)," this means a range whose limits include both numbers. For example, "25 to 100" means a range whose lower limit is 25 and upper limit is 100 and includes both 25 and 100.

Figure 1:
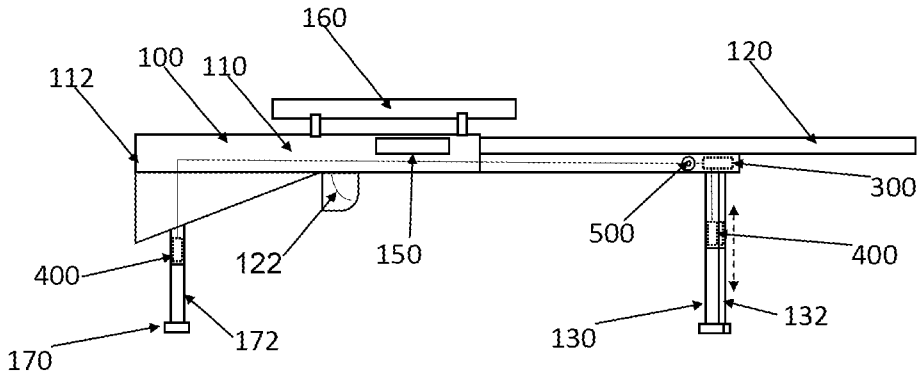
FIG. 1 shows an example side view of a gun with a first forward rest attached to the stock of the gun.

FIG. 1 shows an example side view of a gun 100 with a first forward rest 130 attached to the stock 110 of the gun 100. The gun 100 may include the stock 110, forward rest 130, barrel 120, action 150, trigger 122, optic 160, rear rest 170, controller 300, and input device 500. The stock 110 may have a butt 112 on a first end of the stock configured to have the shoulder of the shooter rest against while the shooter fires the gun 100. The forward rest 130 may be directly connected to the stock 110 or connected to another portion of the gun 100 in front of (i.e., away from the first end) the trigger 122. The forward rest 130 may include two legs 132 (i.e., a bipod rest) with at least one actuator 400 in each leg 132. Actuators 400 may be configured to adjust the length of the legs, adjust angle between the legs, adjust the relative angle of the legs to the stock 110 as well as other movement adjustments. The legs 132 may include metal or other durable material suitable for the stresses of firing a firearm. The stock 110 may include wood, metal, composite, and other durable materials suitable for the stresses of firing a firearm. The action 150 may be any sort of action for a firearm including bolt action, beach loading action, semi-automatic action, automatic action, etc. The trigger 122 may be mechanically connected to the action 150 to cause the gun 100 to fire a projectile when loaded and the trigger 122 is depressed. The barrel 120 may extend from the action 150 and allow a projectile to travel out of the gun 100. The optic 160 may include a magnification device and an aim indicator. The optic 160 may be mounted above the stock 110 and above the action 150 and in line with the barrel 120.

The rear rest 170 may have a single leg 172 extending down from the butt 112 used to lift the gun 100 to the shoulder of the shooter. The rear rest 170 may be particularly useful for shooting from a prone position and may have an adjustable height of 0-12 inches. The rear rest 170 may have different heights if designed for use in a kneeling or standing position and may have an adjustable height configured to allow the butt 112 to rest on the shoulder of the shooter for the designed shooting position. The rear rest 170 may also include an actuator 400 which may be controlled by the controller 300 based on input from the input device 500. The rear rest 170 may be made of similar materials and with a similar construction as the forward rest 130. The rear rest may be connected to the butt 112 or any other point on the gun 100 behind (toward the first end) the trigger 122.

The forward rest 130 may be connected directly and rigidly to the stock 110 such that the legs 132 are moved when the stock 110 is moved. This can help the forward rest 130 be able to maintain the gun 100 level during shooting. In some embodiments, the stock 110 may be able to rotate relative to the forward rest 130 while remaining level so that the feet of the forward rest do not have to move when the barrel 120 angle is adjusted for distance. Restated, the stock 110 may be able to rotate relative to the forward rest 130 in a vertical plane.

The input device 500 may include a joystick, buttons, and/or other mechanism such as a touchpad for an input to be received from a shooter's fingers. In other embodiments, input device 500 may be a controller interface that receives audio command or signals. The input device 500 may be simple enough to control that the shooter does not need to look at the input device 500. The input device 500 may be mounted on, off, or in the stock 110 in a location where either hand of the shooter could naturally be when firing the gun 100. The controller 300 may be embedded in or attached to the stock 110. The controller 300 may be configured to receive input from the input device 500 and control the actuators 400 to adjust the leg lengths of the legs 132 and leg 172 according to the received commands. The controller 300 is shown in dotted lines to show that it may be embedded in the stock 110. Similarly, the actuators 400 are shown in dotted lines to show that the actuators 400 may be embedded in the legs 132, 172.

Example commands may include (if the input device includes a joystick): a command to raise the height of the forward rest 130 by receiving an "up" command from the joystick input device 500 being moved up; a command to lower the height of the forward rest 130 by receiving a "down" command from the joystick input device 500 being moved up; a command to adjust the aim of the gun 100 laterally right by receiving a "right" command from the joystick input device 500; and a command to adjust the aim of the gun 100 laterally left by receiving a "left" command from the joystick input device 500. During the execution of each of these commands, the gun 100 may be maintained with the optic 160 in line with the barrel 120 (i.e., level) using a level sensor (which may be included in the controller 300 or may be separate from the controller 300). The actuators 400 may be controlled by the controller 300 and may be electrically actuated (e.g., include electric motors to cause components of the legs 132 and leg 172 to move to adjust the length/height of the legs 132 and leg 172). Another command may be an "on" command received from a power button of the input device 500, where the controller 300 may automatically adjust the length of the legs 132 and leg 172 to level the gun 100. The length of the leg 172 may be adjusted to a preset height which the shooter can program using the input device 500 and the controller 300. The height of the leg 172 may also be adjusted using the input device 500. The legs 132 may be foldable against the stock 110 for easier storage and transportation and the "on" command may also cause actuators 400 to unfold or extend the legs 132 from the stock 110. The leg 172 may be foldable, or may retract into the butt 112. Other commands may also be received which assist the shooter in adjusting the height or direction the gun 100 is pointed without moving a location of the legs 132 of the gun 100 (other than changing the height/length of the legs) and without causing the shooter to move. In some cases, the height of the leg 172 may be adjusted based on commands to adjust the legs 132 to reduce movement of the butt 112 relative to the shoulder of the shooter when the legs 132 are moved.

The ability for the forward rest 130 to adjust without the shooter moving or the gun 100 having to be taken off target is a very large advantage. In a hunting context, game animals' vision is very sensitive to movement. In a first example, a hunter that has set up prone for a long distance shot but then sees a target game animal that is closer may need to adjust the barrel 120 of the gun down to aim at the new target, this can cause the back of the stock 110 to raise up. This may cause the shooter to have to adjust his/her position to have the stock 110 properly situated on the shoulder of the shooter. This movement of the shooter may be large enough for the game animal to see and be frightened and run. However, if the height of the forward rest 130 is instead adjusted to lower the forward rest 130 without the hunter changing position, then the back of the stock 110 may be maintained in the same position and only the barrel 120 of the gun 100 may move causing a much smaller movement that is less likely to frighten the game animal or even be noticed by the animal. In a second example, a hunter may be tracking the movement of a game animal that is moving laterally in his line of sight. The hunter may have to lift the gun 100 to adjust the positioning of the front end of the gun 100 and the forward rest 130 while visually tracking the animal. In some cases, the hunter may have to adjust his body positioning as well. This movement may be seen by the game animal which may cause it to run. However, if the lateral positioning of the stock 110 relative to the forward rest 130 is changed instead, a much smaller motion of only the front of the gun 100 may be made, which is much less likely to be noticed by the game animal. The controller 300 may be programmed to maintain position of the rear of the gun 100 and thus maintain the position of the shoulder of the shooter while adjusting the aim (i.e., direction the barrel is pointing) of the gun so that the shooter does not need to adjust in position if the adjustment is within a certain range. This range may depend on the length of the legs 132, for example, for legs of about 6-12 inches of adjustable length, an angle difference of about 0-120 degrees to each side and up and down may be made without the shooter having to adjust position. For legs 132 of greater length, greater adjustment windows may be possible.

Figure 2:
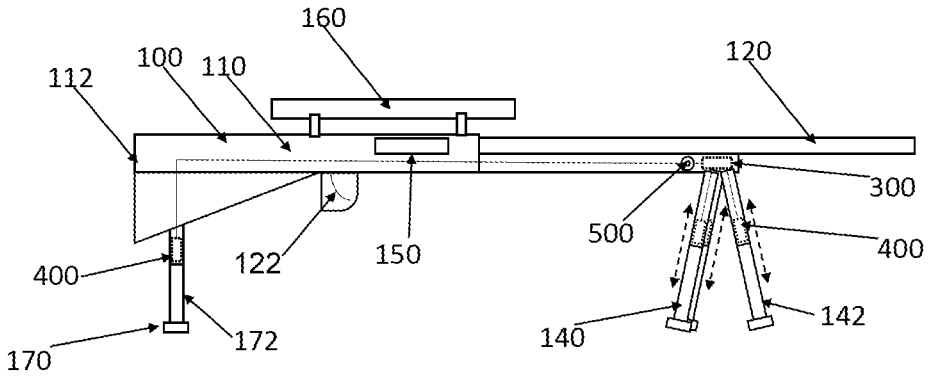
FIG. 2 shows an example side view of a gun with a second forward rest attached to the stock of the gun.

FIG. 2 shows an example side view of a gun with a second forward rest 140 attached to the stock 110 of the gun 100. Only the second forward rest 140 replacing the first forward rest 130 may be different from the embodiment shown in FIG. 1. The second forward rest 140 may include three legs 142 (i.e., a tripod rest) of similar material and construction as the legs 132 of the first forward rest 130. Each of the legs 142 may include an actuator 400 that can adjust the length of the leg 142. In some embodiments the forward rest 140 may be connected directly and rigidly to the stock 110 such that the legs 142 are moved when the stock 110 is moved. In some embodiments, the stock 110 may be able to rotate relative to the forward rest 140 while remaining level so that the feet of the forward rest do not have to move when the barrel 120 angle is adjusted for distance. Restated, the stock 110 may be able to rotate relative to the forward rest 140 in a vertical plane. The legs 142 may be arranged with two legs 142 behind a forward leg 142. The tripod forward rest 140 may have example leg 142 lengths of adjustable 6-12 inch length for prone shooting, adjustable 24-36 inch legs for kneeling shooting, or adjustable 50-75 inch legs for standing shooting. However, these are only examples and these lengths may not work for shooters of all sizes, thus adjustments may be made to the example lengths of the legs 142.

Figure 3:
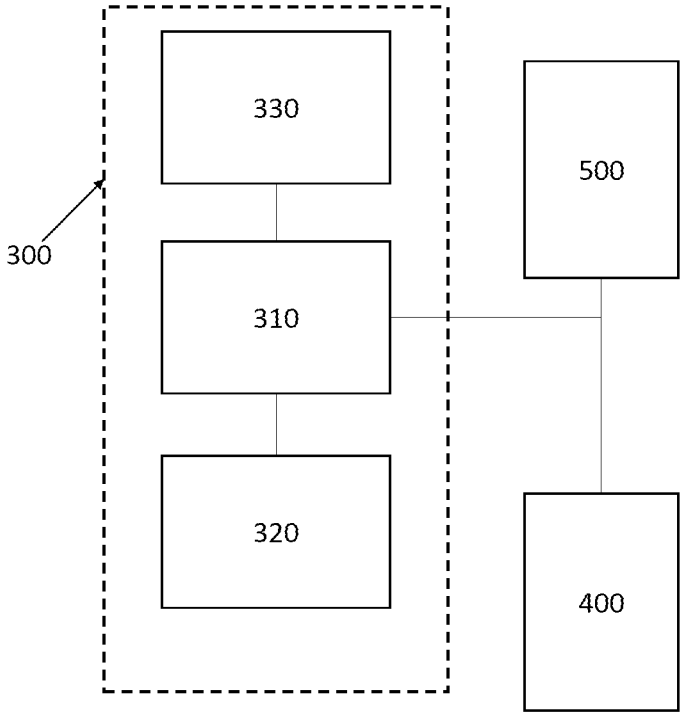
FIG. 3 shows a schematic view of a controller, actuators, and an input device.

FIG. 3 shows a schematic view of the controller 300, the actuators 400, and the input device 500. The controller 300 may be electrically connected to the actuators 400 and the input device 500 and may send and receive commands from the actuators 400 and the input device 500. The controller 300 may include a processor 310, a memory 320, and sensors 330. The sensors 330 may include a leveling sensor as well as other sensors. The memory 320 may include one or more volatile or nonvolatile memories that include instructions for controlling the movement of the actuators 400. The processor 310 may be configured to execute those instructions based on commands received from the input device 500 and the sensors 330 whereby legs 142 may tilt at a certain angle such that the leveling sensor is balanced, which may be useful in the field with uneven terrains.

Accordingly, the present description provides for various embodiments for a gun stock 110 with an attached forward rest 130, 140. Many uses and advantages are offered by the gun stock 110 with attached forward rest 130, 140 as described above in one or more non-limiting embodiments in the present description.

The corresponding structures, materials, acts, and equivalents of any means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention, according to one or more embodiments described in the present description, may be practiced with modification and alteration within the spirit and scope of the appended claims. Thus, the description is to be regarded as illustrative instead of restrictive of the present invention.

What is claimed is:

1. A shooting rest system comprising:

a plurality of legs including actuators configured to adjust a length and angle of each leg of the plurality of legs, wherein the plurality of legs are attached to a firearm such that adjustments are makeable while in a shooting position;

an input device connected to the firearm and configured to receive an input for controlling adjustment of the angle or the length of each leg of the plurality of legs; and a controller configured to receive an input signal from the input device and send commands for one or more actuators to change the angle or the length of each leg of the plurality of legs, wherein the controller is connected to a level sensor used to maintain an optic of the firearm in line with a barrel of the firearm, wherein the plurality of legs or the one or more actuators are configured to move from a first configuration to a second configuration by tilting such that the level sensor is balanced, maintaining leveling through ranges of motion.

2. The shooting rest system of claim 1, wherein the controller is configured to synchronize movement of the plurality of legs wherein the plurality of legs are adjustable to a preset height that is programmable by the controller.

3. A shooting rest system for a gun, the shooting rest system comprising:

a forward rest having a first leg connected to the gun at a first distance from a front of the gun, the first leg including one or more actuators configured to adjust the first leg and a second leg connected to the gun at the first distance, the second leg including one or more second actuators configured to adjust the second leg separately from the first leg;

a third leg connected to the gun at a second distance rearward along a length of the gun from the first leg and the second leg, the third leg including one or more third actuators configured to adjust the third leg separately from the first leg and the second leg;

a controller including a processor and memory, the controller configured to receive an input signal from an input device and send commands for the one or more actuators, the one or more second actuators, and the one or more third actuators to change a height of the first leg, the second leg, and the third leg, wherein the controller is connected to a level sensor used to maintain an optic of the gun in line with a barrel of the gun, wherein the legs are configured to tilt at an angle such that the level sensor is balanced.

4. The shooting rest system of claim 3, wherein the controller performs steps of: adjusting aim of the gun laterally to a left direction or a right direction.

5. The shooting rest system of claim 3, wherein the controller performs steps of: adjusting aim of the gun to raise the height of the first leg and the second leg.

6. The shooting rest system of claim 3, wherein the controller performs steps of: adjusting the first leg, the second leg, and the third leg to a preset height of a plurality of preset heights storable in the memory by a user.

* * * * *